US008292286B2

(12) United States Patent
Mizuno et al.

(10) Patent No.: US 8,292,286 B2
(45) Date of Patent: Oct. 23, 2012

(54) IMAGE FORMING APPARATUS

(75) Inventors: Toru Mizuno, Nagoya (JP); Kenta Horade, Tokai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 34 days.

(21) Appl. No.: 13/053,557

(22) Filed: Mar. 22, 2011

(65) Prior Publication Data

US 2011/0309571 A1 Dec. 22, 2011

(30) Foreign Application Priority Data

Jun. 17, 2010 (JP) ..... 2010-138428
Jun. 18, 2010 (JP) ..... 2010-139496

(51) Int. Cl.
*B65H 5/22* (2006.01)

(52) U.S. Cl. ..... 271/4.03; 271/10.03; 271/266; 271/270

(58) Field of Classification Search ..... 271/4.04, 271/10.03, 258.01, 258.02, 265.01, 266, 271/270, 4.03
See application file for complete search history.

(56) References Cited

U.S. PATENT DOCUMENTS

2009/0166965 A1 7/2009 Fukasawa

FOREIGN PATENT DOCUMENTS

JP 2009-155038 A 7/2009

*Primary Examiner* — Michael McCullough
(74) *Attorney, Agent, or Firm* — Scully, Scott, Murphy & Presser, PC

(57) ABSTRACT

An image recording apparatus including: (i) a first controlling portion configured to intermittently convey a following sheet at a second velocity together with intermittent conveyance of a preceding sheet at a first velocity higher than the second velocity; (ii) a predicting portion configured to predict one of the successive intermittent conveyances of the following sheet which is performed together with one of the successive intermittent conveyances of the preceding sheet which causes the trailing end of the preceding sheet to pass a reference position; and (iii) a second controlling portion configured to inhibit the predicted one of the successive intermittent conveyances of the following sheet, and configured to convey the following sheet at a third conveying velocity higher than the second conveying velocity, from a point of time at which the trailing end of the preceding sheet passes the reference position, such that conveyance of the following sheet at the third conveying velocity is stopped without a leading end of the following sheet being brought into contact with the trailing end of the preceding sheet.

9 Claims, 9 Drawing Sheets

IMAGE FORMING APPARATUS

CROSS REFERENCE TO RELATED APPLICATION

This application claims priority from Japanese Patent Applications No. 2010-138428 filed on Jun. 17, 2010 and No. 2010-139496 filed on Jun. 18, 2010, the disclosures of which are herein incorporated by reference in its entirety.

BACKGROUND OF THE INVENTION

Field of the Invention

The present invention relates to an image forming apparatus for forming an image on a sheet.

There is conventionally known an inkjet printer as a kind of an image forming apparatus for forming an image on a sheet. In this kind of the image forming apparatus, the sheet is intermittently conveyed in a sub-scanning direction such that the sheet is conveyed by a predetermined distance as a result of each one of successive intermittent conveyances of the sheet, while an image forming unit is moved in a main scanning direction after each one of the successive intermittent conveyances of the sheet, whereby an image is formed on a sheet. Further, in this kind of the image forming apparatus, there is known an arrangement in which conveyance of a following sheet is started when a trailing end of a preceding sheet is detected by a sensor.

SUMMARY OF THE INVENTION

The present inventors have studied an arrangement in which successive intermittent conveyances of a following sheet are performed together with successive intermittent conveyances of a preceding sheet in a process of formation of an image on the preceding sheet (that is conveyed in a sub-scanning direction) by an image forming unit (that is moved in a main scanning direction). According to this arrangement, the following sheet can be conveyed as if the following sheet chases a trailing end of the preceding sheet, so that the following sheet can be rapidly positioned in an image formation position after formation of the image on the preceding sheet.

However, in the above-described arrangement in which the successive intermittent conveyances of the following sheet are performed together with the successive intermittent conveyances of the preceding sheet, if the following and preceding sheets are conveyed at the same distance as a result of each one of the successive intermittent conveyances, there is a risk that the following sheet is caused to collide or overlap with the trailing end of the preceding sheet, due to error in conveyance accuracy. For avoiding such a risk, the present inventors have studied that the following sheet is conveyed at a velocity lower than a velocity of conveyance of the preceding sheet so that the following sheet is conveyed by a distance smaller than a distance of conveyance of the preceding sheet.

However, in this case in which the velocity of conveyance of the following sheet is lower than the velocity of conveyance of the preceding sheet, a distance between the following sheet and the trailing end of the preceding sheet is increased as the intermittent conveyance is repeated, thereby causing delay in supply of the following sheet to the image formation position.

The present invention was made in view of such a background. It is therefore an object of the invention to provide a technique for enabling the following sheet to be rapidly positioned in the image formation position in an image forming apparatus in which the successive intermittent conveyances of the following sheet are performed together with the successive intermittent conveyances of the preceding sheet.

The above object of the invention may be achieved according to a principle of the invention, which provides an image recording apparatus including: (a) an image forming device configured to form an image on a sheet in an image formation position; (b) a conveyance controlling device configured to intermittently convey the sheet toward the image formation position at a first conveying velocity along a sheet conveyance path, by activating a sheet conveying mechanism that is disposed on an upstream side of the image formation position in the sheet conveyance path, such that the sheet is conveyed toward the image formation position by a first distance, as a result of each one of successive intermittent conveyances of the sheet which is performed by the conveyance controlling device; (c) a supply controlling device configured to supply the sheet to the sheet conveying mechanism, by activating a sheet supplying mechanism that is disposed on an upstream side of the sheet conveying mechanism in the sheet conveyance path; and (d) a judging device configured to judge whether or not a trailing end of the sheet conveyed by the conveyance controlling device has passed a reference position that is located between the sheet conveying mechanism and the sheet supplying mechanism in the sheet conveyance path, wherein the supply controlling device is constructed as described below.

The supply controlling device includes a first controlling portion, a predicting portion and a second controlling portion. The first controlling portion is configured to intermittently convey another sheet as a following sheet following the sheet as a preceding sheet, toward the sheet conveying mechanism at a second conveying velocity lower than the first conveying velocity along the sheet conveyance path, by activating the sheet supplying mechanism when the preceding sheet is being intermittently conveyed by the conveyance controlling device, such that the following sheet is conveyed toward the sheet conveying mechanism by a second distance shorter than the first distance, as a result of each one of successive intermittent conveyances of the following sheet which is performed by the first controlling portion together with a corresponding one of the successive intermittent conveyances of the preceding sheet which is performed by the conveyance controlling device.

The predicting portion is configured to predict one of the successive intermittent conveyances of the following sheet which is to be performed together with one of the successive intermittent conveyances of the preceding sheet which is to be performed to cause the trailing end of the preceding sheet to pass the reference position. The second controlling portion is configured to inhibit the predicted one of the successive intermittent conveyances of the following sheet, and is configured to convey the following sheet toward the sheet conveying mechanism at a third conveying velocity higher than the second conveying velocity along the sheet conveyance path, by activating the sheet supplying mechanism from a point of time at which the judging device judges that the trailing end of the preceding sheet has passed the reference position, such that conveyance of the following sheet at the third conveying velocity is stopped without a leading end of the following sheet being brought into contact with the trailing end of the preceding sheet. It is noted that the second controlling portion may be configured to convey the following sheet toward the sheet conveying mechanism at the third conveying velocity, by activating the sheet supplying mechanism from the point of time at which the judging device judges that the trailing end of the preceding sheet has passed the reference position, to a point of time at which a leading end of the following sheet reaches a predetermined position corresponding to one of the reference position and a downstream-side position that is located on a downstream side of the reference position in the sheet conveyance path.

In the image forming apparatus constructed as described, each one of the successive intermittent conveyances of the following sheet at the second conveying velocity is performed by the first controlling portion of the supply controlling device, together with a corresponding one of the successive intermittent conveyances of the preceding sheet at the first velocity, which is performed by the conveyance controlling device. The second controlling portion of the supply controlling device is configured to inhibit the predicted one of the successive intermittent conveyances of the following sheet (which is to be performed together with the one of the successive intermittent conveyances of the preceding sheet which is to be performed to cause the trailing end of the preceding sheet to pass the reference position), and to start conveying the following sheet toward the sheet conveying mechanism at the third conveying velocity higher than the second conveying velocity at the point of time at which the judging device judges that the trailing end of the preceding sheet has passed the reference position. Therefore, the conveyance of the following sheet by the second controlling portion can be performed rapidly, whereby the following sheet can be rapidly supplied to the sheet conveying mechanism.

The first controlling of the supply controlling portion is configured to intermittently convey the following sheet at the second conveying velocity lower than the first conveying velocity so that the preceding sheet is not caught up with by the following sheet. The second controlling portion of the supply controlling portion serves to adjust position of the following sheet such that the following sheet is conveyed toward the sheet conveying mechanism rapidly as much as possible, without causing the leading end of the following sheet to be brought into contact with the trailing end of the preceding sheet. To this end, the second controlling portion is configured, in case of inhibition of the predicted one of the successive intermittent conveyances of the following sheet, to start conveying the following sheet toward the sheet conveying mechanism at the third conveying velocity at the point of time at which the trailing end of the preceding sheet has passed the reference position. In an arrangement in which the predicted one of the successive intermittent conveyance of the following sheet is not inhibited, the predicted one of the successive intermittent conveyance of the following sheet is performed by the first controlling portion together with the one of the successive intermittent conveyances of the preceding sheet, in a stage in which the trailing end of the preceding sheet passes the reference position. Therefore, in this arrangement, the conveyance of the following sheet at the third conveying velocity by the second controlling portion can not be started at the point of time at which the trailing end of the preceding sheet has passed the reference position, because the conveyance of the following sheet is being performed by the first controlling portion at the point of time at which the trailing end of the preceding sheet has passed the reference position. That is, the high-velocity conveyance of the following sheet by the second controlling portion can not be started until the low-velocity conveyance of the following sheet by the first controlling portion is completed.

In the above-described arrangement in which the predicted one of the successive intermittent conveyance of the following sheet is not inhibited, the high-velocity conveyance of the following sheet by the second controlling portion can not be started until the low-velocity conveyance of the following sheet by the first controlling portion is completed, even after the trailing end of the preceding sheet has passed the reference position, namely, even after it has become possible to convey the following sheet at the third conveying velocity at least to the reference position, without causing the leading end of the following sheet to be brought into contact with the trailing end of the preceding sheet. In the above-described arrangement, consequently, the supply of the following sheet to the sheet conveying mechanism is delayed.

On the other hand, in the image forming apparatus constructed according to the invention in which the predicted one of the successive intermittent conveyance of the following sheet (which is to be performed together with one of the successive intermittent conveyances of the preceding sheet which is to be performed to cause the trailing end portion of the preceding sheet to pass the reference position) is inhibited, the high-velocity conveyance of the following sheet by the second controlling portion can be started at the point of time at which the trailing end of the preceding sheet has passed the reference position. In the image forming apparatus according to the invention, consequently, the supply of the following sheet to the sheet conveying mechanism can be made rapidly.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

First Embodiment

Figure 1:
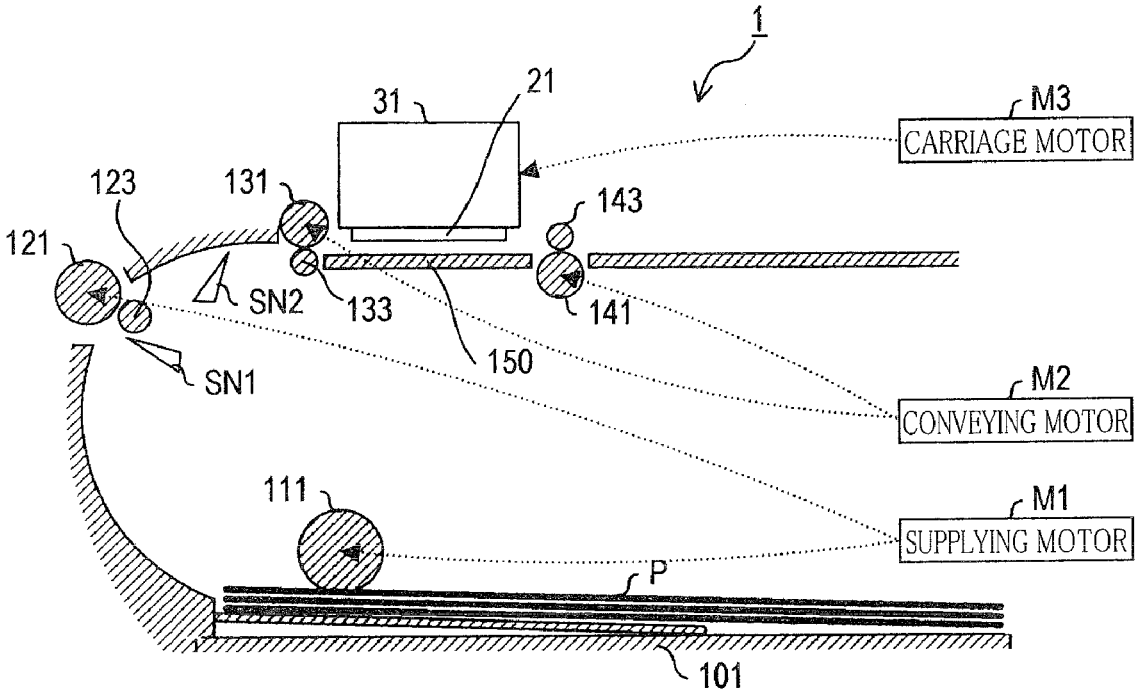
FIG. 1 is a cross sectional view showing construction of an image forming apparatus 1 constructed according to a first embodiment of the invention.

FIG. 1 shows an image forming apparatus 1 constructed according to a first embodiment of the invention. The image forming apparatus 1 is an inkjet printer, and includes an image forming unit 21, a carriage 31, a sheet supply tray 101, a supplying roller 111, an intermediate roller 121, a conveying roller 131, a discharging roller 141, a supplying motor M1, a conveying motor M2, a CR (carriage) motor M3, a sheet sensor SN1 and a register sensor SN2. The carriage 31 is provided for moving the image forming unit 21 in a main scanning direction perpendicular to a conveyance direction (sub-scanning direction) in which a sheet P is to be conveyed. The supplying roller 111 is provided for picking up an uppermost one of the sheets P stacked on the sheet supply tray 101 so as to supply the sheets P one after another to a sheet conveyance path. The intermediate roller 121 is provided for conveying the sheet P, which has been supplied to the sheet conveyance path by rotation of the supplying roller 111, along the sheet conveyance path. The conveying roller 131 is provided for conveying the sheet P, which has been conveyed by rotation of the intermediate roller 121, to an image formation position (i.e., an ejected-ink receiving position) that is located below the image forming unit 21. The discharging roller 141 is provided for discharging the sheet P, which has been conveyed by rotation of the conveying roller 131, toward a downstream end portion of the sheet conveyance path.

The supplying roller 111 is to be rotated by a driving source in the form of the supplying motor M1 that is constituted by a DC (direct current) motor. The supplying roller 111 serves to separate an uppermost one of the sheets P stacked on the sheet supply tray 101, from the other sheets P, so as to supply the separated sheet P to the sheet conveyance path. The sheet conveyance path is configured to limit movement of the sheet P, so as to guide the sheet P supplied by the supplying roller 111 from the sheet supply tray 101, to be introduced through the intermediate roller 121 into between the conveying roller 131 and a pinch roller 133 that are located on a downstream side of the intermediate roller 121 in the sheet conveyance path.

The intermediate roller 121 is disposed between the supplying roller 111 and the conveying roller 131 in the sheet conveyance path. The intermediate roller 121 cooperates with a pinch roller 123 to pinch the sheet P which has been conveyed from the supplying roller 111, and is configured to convey the sheet P along the sheet conveyance path by its own rotation. This intermediate roller 121 as well as the supplying roller 111 is to be rotated by the supplying motor M1 as the driving source, and serves to supply the sheet P having conveyed from the supplying roller 111, to the conveying roller 131.

The conveying roller 131 is disposed on an upstream side of the above-described image formation position in the sheet conveyance path, and is to be rotated by a driving source in the form of the conveying motor M2. The conveying roller 131 cooperates with the pinch roller 133 to pinch the sheet P having been conveyed from the intermediate roller 121, and is configured to convey the sheet P to the image formation position by its own rotation.

The discharging roller 141 is disposed on a downstream side of the image formation position in the sheet conveyance path, and is to be rotated together with the conveying roller 131 by the conveying motor M2. The discharging roller 141 cooperates with a pinch roller 143 to pinch the sheet P having been conveyed from a position of disposition of the conveying roller 131, and is configured to convey the sheet P toward a sheet exit tray (not shown) by its own rotation. In the present embodiment, a single pair of rollers consisting of the discharging roller 141 and the pinch roller 143 is provided, as shown in FIG. 1. However, two or more than two pairs of rollers each consisting of the discharging roller 141 and the pinch roller 143 may be provided in the downstream end portion of the sheet conveyance path which is located between the image formation position and the sheet exit tray (not shown).

In the image forming apparatus 1 constructed according to the present embodiment, each of the sheets P stacked on the sheet supply tray 101 is supplied by the supplying roller 111 to the sheet conveyance path, and is conveyed to the conveying roller 131 via the intermediate roller 121 that is disposed in the sheet conveyance path. Then, each sheet P is conveyed to the image formation position by rotation of the conveying roller 131, and is discharged by rotation of the discharging roller 141 after a series of images have been formed on the sheet P. In the sheet conveyance path, there are disposed the above-described sheet sensor SN1 and register sensor SN2 as sensors capable of detecting an end of each sheet P.

Specifically described, the sheet sensor SN1 is disposed in such a position that enables this sheet sensor SN1 to detect an end of the sheet P passing a position of disposition of the intermediate roller 121 (i.e., a position in which the sheet P is to be nipped between the intermediate roller 121 and the pinch roller 123). Meanwhile, the register sensor SN2 is disposed in a position which is located on an upstream side of the conveying roller 131 in the sheet conveyance path and which is located in vicinity of the position of disposition of the conveying roller 131. These sheet sensor SN1 and register sensor SN2 serve to determine a position of the sheet P in the sheet conveyance path.

The image forming unit 21 has nozzles which open in its bottom surface and which is configured to eject ink droplets. The nozzles are disposed to be opposed to a platen 150 which is disposed between the conveying roller 131 and the discharging roller 141 and which defines a part of the sheet conveyance path. The image forming unit 21 is carried on the carriage 31, which is movable in the main scanning direction by a driving source in the form of the CR motor M3 that is constituted by a DC motor. It is noted that the main scanning direction corresponds to a direction perpendicular to drawing sheet of FIG. 1.

A carriage movement mechanism (whose detail is not illustrated in the drawings) includes, in addition to the CR motor M3, an endless belt (to which the carriage 31 is connected) and a guide rod (along which the carriage 31 is to be moved). The endless belt can be circulated by a driving force of the CR motor M3, so that the carriage 31 can be caused, by the circulated endless belt, to be moved along the guide rod that extends in the main scanning direction.

Figure 2:
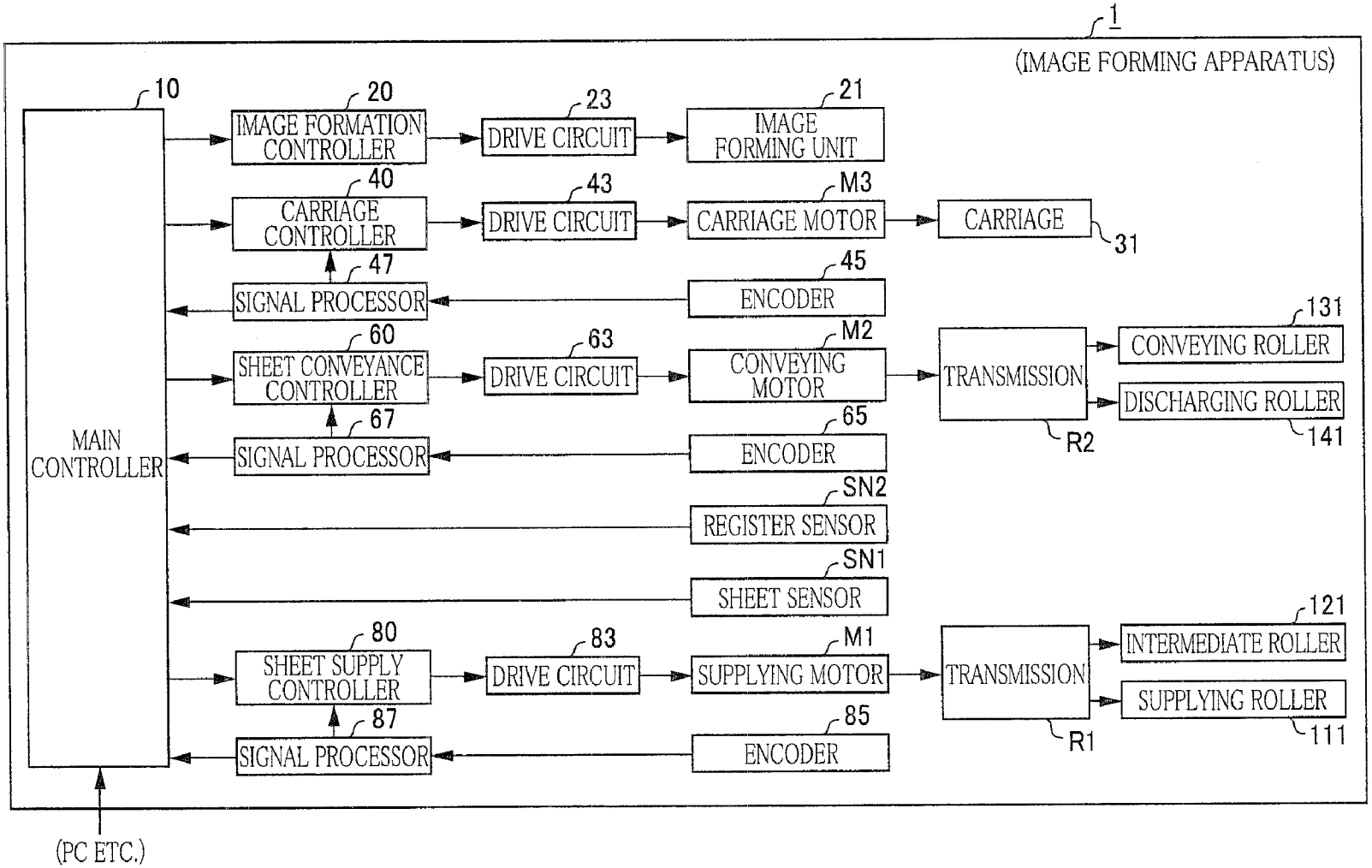
FIG. 2 is a block diagram showing an electrical arrangement in the image forming apparatus 1.

Referring next to FIG. 2, there will be described an electrical arrangement of the image forming apparatus 1. For controlling and driving the image forming unit 21, carriage 31 and rollers 111, 121, 131, 141, the image forming apparatus 1 has a main controller 10, an image formation controller 20, a carriage controller 40, a sheet conveyance controller 60, a sheet supply controller 80, drive circuits 23, 43, 63, 83, encoders 45, 65, 85 and signal processors 47, 67, 87.

The image formation controller 20 is configured to control activation of the image forming unit 21 for ejecting ink droplets. Specifically, the image formation controller 20 is configured, in accordance with commands inputted from the main controller 10, to drive the image forming unit 21 via the drive circuit 23, so as to control activation of the image forming unit 21 for ejecting ink droplets, whereby a series of images based on a print image data inputted into the image formation controller 20 from the main controller 10, are formed on the sheet P by the image forming unit 21.

The carriage controller 40 is configured to control movement of the carriage 31 by activating the CR motor M3 via the drive circuit 43. For example, during image formation on the sheet P, the carriage controller 40 controls the carriage 31 such that the carriage 31 is moved at a constant velocity, for enabling ink droplets to be placed in desired positions on the sheet P. The carriage controller 40 carries out such a control of movement of the carriage 31, in accordance with commands supplied from the main controller 10. For performing the control of movement of the carriage 31, the carriage controller 40 receives, from the signal processor 47, information representing position and movement velocity of the carriage 31. The signal processor 47 is configured to process encoder signals (A-phase signal and B-phase signal) supplied from the encoder 45, so as to detect position and movement velocity of the carriage 31. The method of detecting the position and movement velocity of the carriage 31 by utilizing the encoder signals is well-known, and detailed description thereof is not provided. The encoder 45 is constituted by, for example, a linear encoder including an encoder scale and a sensor element, wherein the liner encoder extends in the main scanning direction while the sensor element is disposed in the carriage 31 so as to read slits provided in the encoder scale.

The sheet conveyance controller 60 is configured to control conveyance of the sheet P, by controlling the conveying motor M2 via the drive circuit 63, in accordance with commands supplied from the main controller 10. The conveying motor M2 is configured to generate a driving force that is to be transmitted to the conveying roller 131 and the discharging roller 141 via a transmission mechanism R2 whereby the conveying roller 131 and the discharging roller 141 can be rotated in synchronization with each other. For performing the control of conveyance of the sheet P, the sheet conveyance controller 60 receives, from the signal processor 67, information representing amount and velocity of conveyance of the sheet P. The signal processor 67 is configured to detect the amount and velocity of conveyance of the sheet P, based on the encoder signals supplied from the encoder 65, and then to supply information representing the detected amount and velocity of conveyance of the sheet P, to the sheet conveyance controller 60. The encoder 65 is constituted by, for example, a rotary encoder that is provided on a rotary shaft of the conveying motor M2. The sheet conveyance controller 60 is configured to control conveyance of the sheet P, based on the above-described information which is supplied from the signal processor 67 and which represents the amount and velocity of conveyance of the sheet P.

The sheet supply controller 80 is configured to supply the sheet P from the sheet supply tray 101 toward the conveying roller 131, by controlling the supplying motor M1 via the drive circuit 83 in accordance with commands supplied from the main controller 10. The supplying motor M1 generates a driving force which is to be transmitted via the transmission mechanism R1 to the supplying roller 111 and/or the intermediate roller 121. For performing control of supply or conveyance of the sheet P, the sheet supply controller 80 receives, from the signal processor 87, information representing amount of and velocity of conveyance of the sheet P. The signal processor 87 is configured to detect the amount and velocity of conveyance of the sheet P, based on the encoder signals supplied from the encoder 85, and then to supply information representing the detected amount and velocity of conveyance of the sheet P, to the sheet supply controller 80. The encoder 85 is constituted by, for example, a rotary encoder that is provided on a rotary shaft of the conveying motor M1. The sheet supply controller 80 is configured to control conveyance of the sheet P, based on the above-described information which is supplied from the signal processor 87 and which represents the amount and velocity of conveyance of the sheet P.

Meanwhile, the main controller 10 includes CPU, ROM, RAM, EEPROM and a communication interface, and is configured to cause the CPU to execute programs stored in the ROM for thereby controlling all devices included in the image forming apparatus 1 so as to cause the image forming apparatus 1 to exhibit the various functions. This main controller 10 is configured, upon reception of a print command (i.e., command requesting formation of an image or a series of images on the sheet P) and a print image data that are supplied from an external device such as a personal computer, to supply commands to the image formation controller 20, carriage controller 40, sheet conveyance controller 60 and sheet supply controller 80, for thereby controlling activation of the image forming unit 21 for performing an image formation, movement of the carriage 31 in the main scanning direction, and conveyance of the sheet P in the sub-scanning direction that is perpendicular to the main scanning direction, so that an image or a series of images based on the print image data supplied from the personal computer is formed on the sheet P.

It is noted that the main controller 10 does not have a storage area sufficient for storing an amount of print image data representing a series of images that are to be formed on the entirety of a single sheet P. Therefore, when the main controller 10 receives the print image data together with the print command from the personal computer, the main controller 10 executes a print control routine while receiving the print image data from the personal computer.

Further, the main controller 10 is configured to acquire information representing an amount of conveyance of the sheet P made by the conveying roller 131 and the discharging roller 141, via the signal processor 67, and also information representing an amount of conveyance of the sheet P made by the supplying roller 111 and the intermediate roller 121, via the signal processor 87, so that the main controller 10 can determine a position X of the sheet P (hereinafter simply referred to as sheet position X) in the sheet conveyance path, based on these acquired information and signals representing detection of an end of the sheet P made by the sheet sensor SN1 and register sensor SN2. That is, although the main controller 10 determines the sheet position X, generally, based on the amount of conveyance of the sheet P, the main controller 10 is configured, when the end of the sheet P is detected by the sheet sensor SN1 or register sensor SN2, to correct the sheet position X (that is determined based on the conveyance amount of the sheet P in this instance) to a position of the sensor SN1 or SN2 (hereinafter simply referred to as sensor position). The sheet position X may represent a position of a leading end of the sheet P, i.e., a position of a front end of the sheet P as viewed in a conveyance direction in which the sheet P is to be conveyed along the sheet conveyance path. In the following descriptions, a front end of the sheet P in the conveyance direction (i.e., an end of the sheet P that is closer to a downstream end portion of the sheet conveyance path than another end of the sheet P) is referred to as "leading end", while a rear end of the sheet P in the conveyance direction (i.e., an end of the sheet P that is closer to an upstream end portion of the sheet conveyance path than another end of the sheet p) is referred to as "trailing end".

Figure 3:
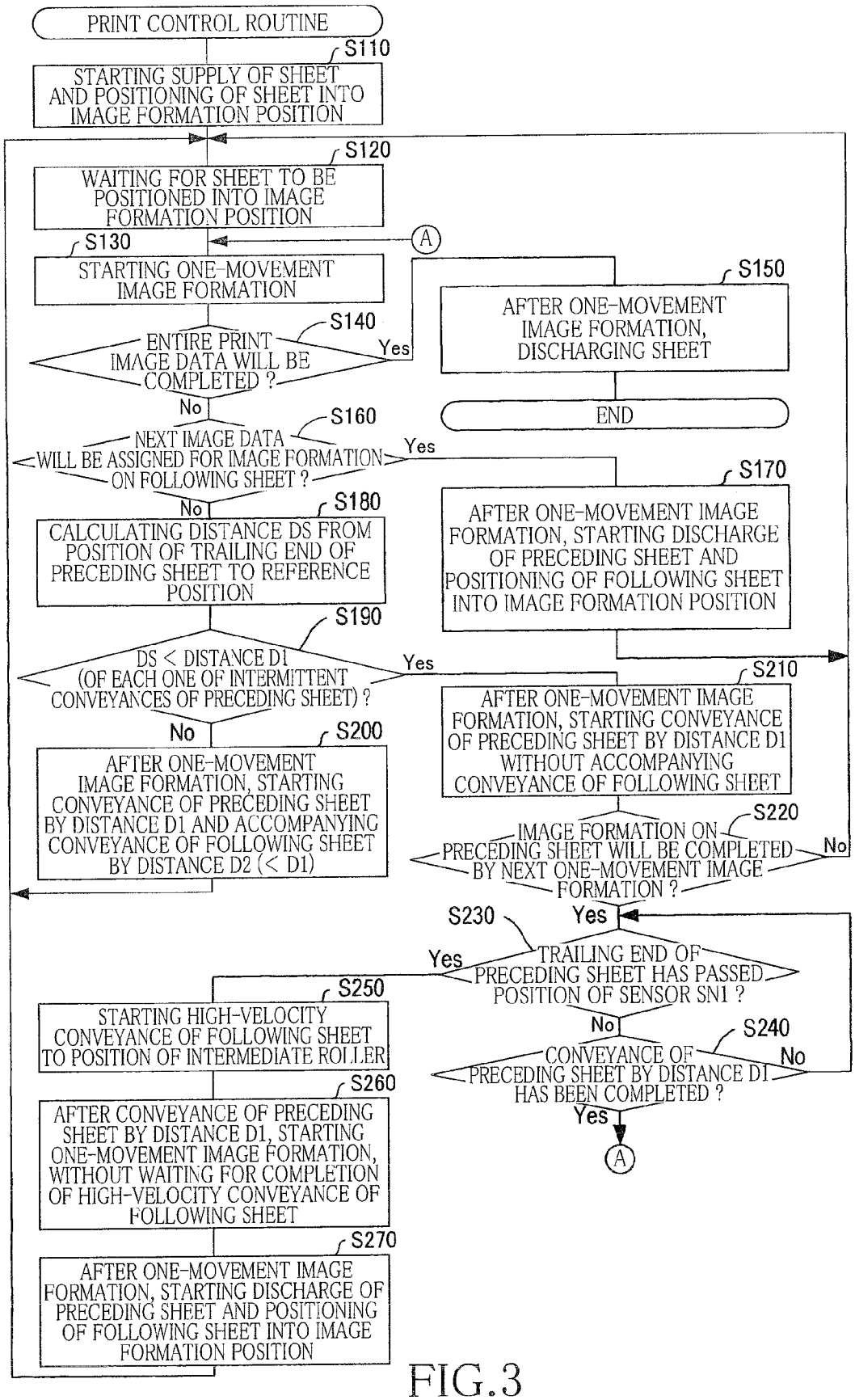
FIG. 3 is a flow chart showing a print control routine that is to be executed by a main control portion 10 in the first embodiment.

Referring next to FIG. 3, there will be described a print control routine, which is to be executed by the main controller 10 when the main controller 10 receives the print command supplied from the personal computer as the external device. The print control routine is initiated with step S110 in which the main controller 10 starts procedure for positioning a sheet P (i.e., sheet P constituting a first page) in an image formation position through the sheet supply controller 80 and the sheet conveyance controller 60. Specifically described, this step S110 is implemented to start procedure for causing the sheet supply controller 80 to supply the sheet P from the sheet supply tray 101 to the conveying roller 131 by rotating the supplying roller 111 and the intermediate roller 121, and for causing the sheet conveyance controller 60 to position the sheet P into the image formation position by rotating the conveying roller 131 and the discharging roller 141.

Step S110 is followed by step S120 in which the main controller 10 waits for the sheet P to be positioned into the image formation position. Then, when the sheet P becomes ready for image formation, step S130 is implemented whereby the main controller 10 starts procedure for so-called "one-movement image formation", which is performed during one movement of the image forming unit 21 together with the carriage 31 in the main scanning direction. Similarly as in a well-known inkjet printer, in the image forming apparatus 1, a series of images based on the print image data are formed on the sheet P by causing the carriage 31 to be reciprocated in the main scanning direction while causing the sheet P to be intermittently conveyed. Further, in the image forming apparatus 1, in a process of formation of the series of images on the sheet P, this step S130 is implemented to start procedure for performing one-movement image formation by causing the carriage controller 40 and the image formation controller 20 to control the CR motor M3 and the image forming unit 21, respectively, such that the carriage 31 is moved at a constant velocity in the main scanning direction from an end of carriage stroke range to another end of the carriage stroke range while the image forming unit 21 ejects ink droplets toward the sheet P during movement of the carriage 31 at the constant velocity. A part of the series of images, which is to be formed by the one-movement image formation procedure, corresponds to a line or lines whose number is dependent on capacity of the image forming unit 21. The series of images are formed on the sheet P, by repeatedly performing the one-movement image formation procedure. It is noted that, in steps S120 and S130, prior to positioning of the sheet P into the image formation position, it is possible to start moving the carriage 31 such that the carriage 31 is accelerated until the movement velocity reaches the constant velocity (see FIG. 4) which is required at least during the image formation.

After the one-movement image formation procedure has been started in step S130, step S140 is implemented whereby the main controller 10 judges whether the formation of the series of images represented by the entire print image data will be completed by the one-movement image formation procedure that has been started in step S130. That is, in step S140, it is judged by the main controller 10 whether or not the image formation based on the entire print image data (including a final end portion of the entire print image data) will be completed by the one-movement image formation procedure that has been started in step S130. When the formation of the series of image represented by the entire print image data will be completed, namely, when a positive judgment (YES) is obtained in step S140, the control flow goes to step S150 in which, after completion of the one-movement image formation procedure having been started in step S130, the conveying roller 131 and the discharging roller 141 are rotated by the sheet conveyance controller 60 so as to discharge the sheet P (on which the series of images has been formed) toward the sheet exit tray (not shown). After implementation of step S150, this print control routine is ended.

On the other hand, when the formation of the series of images represented by the entire image data will not be completed by the one-movement image formation procedure having been started in step S130, namely, when a negative judgment (NO) is obtained in step S140, the control flow goes to step S160 in which it is judged whether a next image data (following the current image data assigned for the one-movement image formation procedure having been started in step S130) is to be assigned for image formation on a next page, namely, requires the sheet P to be replaced with a new sheet P. When the next image data is to be assigned for the image formation on the next page, namely, when a positive judgment (YES) is obtained in step S160, the control flow goes to step S170 in which a next procedure is started after completion of the one-movement image formation procedure having been started in step S130. That is, step S170 is implemented to start the next procedure for discharging the preceding sheet P and positioning the following sheet P into the image formation position, by causing the sheet conveyance controller 60 and the sheet supply controller 80 to control the conveying roller 131, discharging roller 141 and supplying roller 111, such that the preceding sheet P (on which the series of images have been formed) is discharged toward the sheet exit tray (not shown) by rotating the conveying roller 131 and the discharging roller 141 under control by the sheet conveyance controller 60 while the following sheet P is started to be supplied toward the conveying roller 131 by rotating the supplying roller 111 under control by the sheet supply controller 80 upon detection of the trailing end of the preceding sheet P by the sheet sensor SN1, and then the following sheet P is positioned into the image formation position by rotating the conveying roller 131 under control by the sheet conveyance controller 60 after the following sheet has been supplied to conveying roller 131. Step S170 is followed by step S120 that is implemented to wait for the following sheet P to be positioned in the image formation position. Then, when the following sheet P becomes ready for image formation, step S130 is implemented whereby the main controller 10 starts procedure for the one-movement image formation that is performed onto the following sheet P.

When the next image data is not to be assigned for the next page, namely, when a negative judgment (NO) is obtained in step S160, the control flow goes to step S180 in which the main controller 10 calculates a distance Ds, as measured along the sheet conveyance path, between the position X1 of the trailing end of the preceding sheet P (having been subjected to the one-movement image formation procedure in step S130) and a reference position which corresponds to the position of disposition of the intermediate roller 121, namely, corresponds to a position Xm in which an end of the sheet P is to be detected by the sheet sensor SN1. Specifically described, the position X1 of the trailing end of the preceding sheet P is determined based on a position X0 of a leading end of the preceding sheet P (which can be determined by an amount of conveyance of the preceding sheet P) and size information which represents a size of the sheets P stacked on the sheet supply tray 101 and which has been supplied together with the print command from the personal computer as the external device. Then, after the determination of the position X1 of the trailing end of the preceding sheet P, the distance Ds (which is represented by an expression $Ds=Xm-X1$) as measured in the sheet conveyance path between the position X1 of the trailing end of the preceding sheet P and the position Xm of detection of an end of the preceding sheet P by the sheet sensor SN1 is calculated.

Step S180 is followed by step S190 in which it is judged whether or not the calculated distance Ds is shorter than a first distance D1 by which the sheet P is to be conveyed as a result of each one of successive intermittent conveyances of the sheet P which is to performed each time the above-described one-movement image formation has been performed. Thus, by judging whether or not the distance Ds is shorter than the first distance D1, it is possible to judge whether or not the trailing end of the preceding sheet P will pass the reference position as a result of a next one of the successive intermittent conveyances of the preceding sheet P. The first distance D1 corresponds to a width of a part of the series of images, which is to be formed by the one-movement image formation procedure, wherein the width is a size of the part of the series of images which is measured in the sub-scanning direction. In the inkjet printer as the image forming apparatus 1 according to the present embodiment, the series of images are formed on the sheet P, by performing the one-movement image formation procedure each time the sheet P has been conveyed by the first distance D1.

When it is judged in step S190 that the distance Ds is not shorter than the first distance D1, namely, when a negative judgment (NO) is obtained in step S190, the control flow goes to step S200 in which, after completion of the one-movement image formation procedure having been started in step S130, the main controller 10 starts procedure for conveying the preceding sheet P by the first distance D1 and conveying the following sheet P by a second distance D2 that is shorter than the first distance D1, by causing the sheet conveyance controller 60 and the sheet supply controller 80 to control the conveying roller 131, discharging roller 141 and supplying roller 111, such that the preceding sheet P is conveyed by rotating the conveying roller 131 and the discharging roller 141 under control by the sheet conveyance controller 60 while the following sheet P is conveyed by rotating the supplying roller 111 under control by the sheet supply controller 80. In this instance, even when the trailing end of the preceding sheet P has not yet passed the supplying roller 111, namely, even when the preceding sheet P is being conveyed by the supplying roller 111 as well as the conveying roller 131, the preceding sheet P is conveyed by the first distance D1 rather than by the second distance D2, since a conveying force applied to the sheet P by the conveying roller 131 (which can be considered to correspond to a nipping force applied to the sheet P by cooperation of the conveying roller 131 and the pinch roller 133, or a friction force generated between the sheet P and the rollers 131, 133) overcomes a conveying force applied to the sheet P by the supplying roller 111. After the trailing end of the preceding sheet P has passed the supplying roller 111, the following sheet P is started to be conveyed by rotation of the supplying roller 111 in this step S200. In the following description, conveyance of the following sheet P by rotation of the supplying roller 111, which is performed together with conveyance of the preceding sheet P by rotation of the conveying roller 131, will be referred to as "accompanying conveyance".

Figure 4:
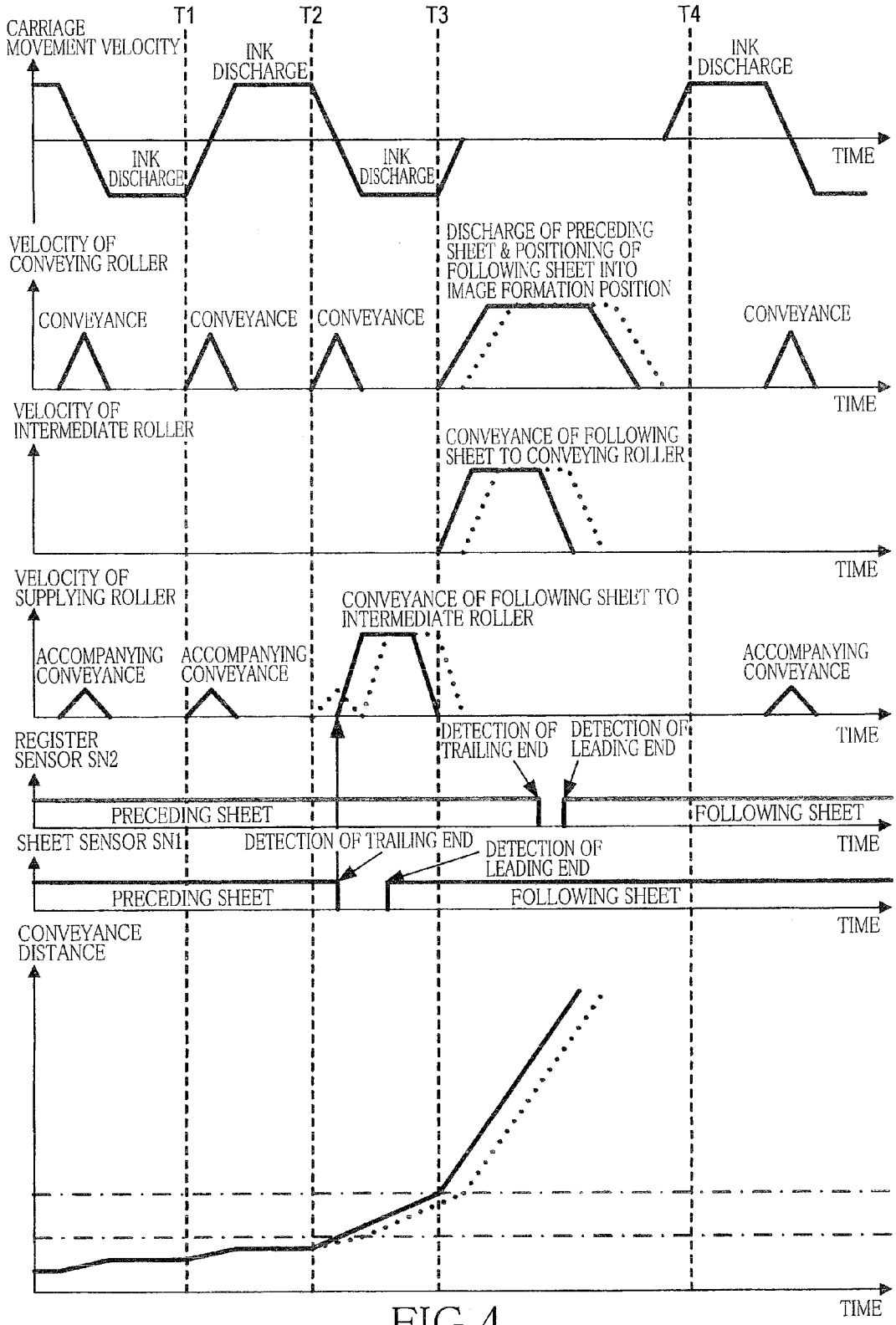
FIG. 4 is a view showing activations of a carriage 31 and rollers in the first embodiment.

FIG. 4 is a time chart showing activations of the carriage 31 and the rollers 111, 121, 131 in various stages. In the procedure having been started in step S200, as shown in a portion of the time chart of FIG. 4 which represents a stage before a point T2 of time, the supplying roller 111 is rotated concurrently with rotation of the conveying roller 131 so that the supplying roller 111 and conveying roller 131 are rotated for the same length of time. However, the supplying roller 111 is rotated at a velocity lower than a velocity of rotation of the conveying roller 131 so that the following sheet P is conveyed by the supplying roller 111 at a velocity (second conveying velocity) lower than a velocity (first conveying velocity) of conveyance of the preceding sheet P that is performed by the conveying roller 131. Since the supplying roller 111 and the conveying roller 131 are rotated for the same length of time, the following sheet P is conveyed by a second distance D2 that is shorter than the first distance D1 by which the preceding sheet P is conveyed.

The above-described accompanying conveyance of the following sheet P is performed for the purpose of making it possible to position the following sheet P into the image formation position, immediately after the series of images have been formed on the preceding sheet P. However, in view of possible error in conveyance accuracy, particularly, in view of large error in amount of conveyance of the sheet P due to fluctuation of conveyance load, which could be caused upon supply of the sheet P from the sheet supply tray 101, the present embodiment employs an arrangement in which the accompanying conveyance is performed by moderately conveying the following sheet P with rotation of the supplying roller 111 at a relatively low velocity, for thereby avoiding contact of the leading end of the following sheet P with the trailing end of the preceding sheet P.

After starting the procedure for conveying the preceding sheet P by the first distance D1 while conveying the following sheet P in accompany with the conveyance of the preceding sheet P in step S200, the control flow goes back to step S120 in which the main controller 10 waits for completions of the conveyance of the preceding sheet P by the first distance D1 and the accompanying conveyance of the following sheet P by the second distance D2. Upon completions of the conveyance of the preceding sheet P and the accompanying conveyance of the following sheet P, step S130 is implemented to start the one-movement image formation procedure whereby another part of the series of image is formed on a portion of the preceding sheet P which is now positioned in the image formation position. The portion of the preceding sheet P, on which the above-described another part of the series of images is to be formed by the current implementation of step S130, is a portion that is shifted, by the first distance D1, from the portion of the preceding sheet P on which the part of the series of images has been formed by the previous implementation of step S130. It is noted that movement of the carriage 31 may be started during the conveyance of the preceding sheet P, namely, before completion of the conveyance of the preceding sheet P by the first distance D1, as long as the conveyance of the preceding sheet P is completed at least before starting of ejection of the ink.

In this print control routine, the one-movement image formation and the intermittent conveyance of the preceding and following sheets P are repeatedly performed. While the one-movement image formation and the conveyance of the preceding and following sheets P are repeatedly performed, a point of time comes when the trailing end of the preceding sheet P passes the position of detection of the trailing end of the preceding sheet P by the sheet sensor SN1. In the present embodiment, this point of time is predicted or estimated by implementations of steps S180, S190, as described above.

That is, the distance Ds (=Xm−X1) is calculated in step S180, and it is judged whether the calculated distance Ds is shorter than the above-described first distance D1 (by which the sheet P is to be conveyed as a result of each one of successive intermittent conveyances of the sheet P) in step S190. When it is judged that the distance Ds is shorter than the first distance D1, namely, when a positive judgment (YES) is obtained in step S190, it is possible to predict that the trailing end of the preceding sheet P will pass the position of detection of an end of the sheet P by the sheet sensor SN1, as a result of a next one of the successive intermittent conveyances of the preceding sheet P. The positive judgment (YES) in step S190 is followed by step S210 in which, after completion of the one-movement image formation procedure having been started in step S130, the main controller 10 starts procedure for conveying the preceding sheet P by the first distance D1 without the accompanying conveyance of the following sheet P, by causing the sheet conveyance controller 60 and the sheet supply controller 80 to control the conveying roller 131, discharging roller 141 and supplying roller 111, such that the conveying roller 131 and the discharging roller 141 are rotated under control by the sheet conveyance controller 60 without the supplying roller 111 being rotated under control by the sheet supply controller 80.

That is, in step S210, as shown in a portion of the time chart of FIG. 4 which represents the point T2 of time, the conveying roller 131 and the discharging roller 141 are rotated so as to start procedure for conveying the preceding sheet P by the first distance D1 with rotations of these rollers 131, 141. Meanwhile, the supplying roller 111 is inhibited from being rotated in accompany with rotation of the conveying roller 131, by not supplying command to the sheet supply controller 80.

Step S210 is followed by step S220 in which it is judged whether or not the image formation on the preceding sheet P will be completed by another one-movement image formation procedure, namely, whether or not the next one-movement image formation procedure will be a final one-movement image formation procedure for the preceding sheet P. In step S220, it is further judged whether or not the entire print image data (supplied together with the print command) contains data that requires image formation on the next page, namely, whether or not the formation of the series of images represented by the entire print image data will be continued to the next page. Thus, in step S220, a negative judgment (NO) is obtained, when it is judged that the image formation on the preceding sheet P will not be completed by the next one-movement image formation procedure and/or that the entire print image data does not contain data that requires image formation on the next page. When the negative judgment (NO) is obtained in step S220, the control flow goes back to step S120 in which the main controller 10 waits for completion of the conveyance of the preceding sheet P that has been started in step S210. Upon completion of the conveyance of the preceding sheet P by the first distance D1, step S130 is implemented to start the one-movement image formation procedure.

On the other hand, in step S220, a positive judgment (YES) is obtained, when it is judged that the image formation on the preceding sheet P will be completed by the next one-movement image formation procedure and that the entire print image data contains data that requires image formation on the next page. When the positive judgment (YES) is obtained in step S220, the control flow goes to step S230 in which it is judged whether or not the trailing end of the preceding sheet P has passed the position of detection of an end of the sheet P by the sheet sensor SN1, namely, whether or not the trailing end of the preceding sheet P has been detected by the sheet sensor SN1. When a negative judgment (NO) is obtained in step S230, the control flow goes to step S240 in which it is judged whether or not the conveyance of the preceding sheet P (that has been started in step S210) has been completed. As long as a negative judgment (NO) is obtained in step S240, the control flow goes back to step S230. When the conveyance of the preceding sheet P has been completed without the trailing end of the preceding sheet P being detected by the sheet sensor SN1, namely, when a positive judgment (YES) is obtained in step S240, it is revealed that the above prediction was wrong, and the control flow goes back to step S130.

When the trailing end of the preceding sheet P is detected by the sheet sensor SN1, namely, when a positive judgment (YES) is obtained in step S230, the control flow goes to step S250 in which, as shown in a portion of the time chart of FIG. 4 that represents a stage between points T2 and T3 of time, the main controller 10 starts procedure for causing the sheet supply controller 80 to convey the following sheet P to the position of disposition of the intermediate roller 121 at a high conveying velocity (third conveying velocity) that is higher than the velocity of the conveyance of the preceding sheet P and the velocity of the accompanying conveyance of the following sheet P, by rotating the supplying roller 111 under control by the sheet supply controller 80.

Step S250 is followed by step S260 in which, immediately after completion of the conveyance of the preceding sheet P (that has been started in step S210) without waiting for completion of the high-velocity conveyance of the following sheet P (that has been started in step S250), the main controller 10 starts procedure for the one-movement image formation in the same manner as in step S130. In the image forming apparatus 1 according to the present embodiment, the image formation on the preceding sheet P is completed by implementation of step S260, and steps following this step S260 are implemented for the image formation on the following sheet P.

In step S270 following step S260, after completion of the image formation on the preceding sheet P, the main controller 10 starts procedure for causing the sheet supply controller 80 and the sheet conveyance controller 60, to convey the following sheet P (that has waited in the position of disposition of the intermediate roller 121) to the position of disposition of the conveying roller 131 so as to be positioned into the image formation position by rotating the intermediate roller 121 under control by the sheet supply controller 80, and to discharge the preceding sheet P toward the sheet exit tray (not shown) by rotating the conveying roller 131 and the discharging roller 141 under control by the sheet conveyance controller 60. In the image forming apparatus 1 according to the present embodiment, the main controller 10 causes the image formation controller 20, carriage controller 40 and sheet supply controller 80 to control the image forming unit 21, carriage 31 and supplying roller 111, respectively, such that the high-velocity conveyance of the following sheet P to the intermediate roller 121 (which has been started in step S250) is completed at latest by completion of the image formation on the preceding sheet P (see FIG. 4). The rotations of the intermediate roller 121 and the conveying roller 131, which are started by implementation of step S270, correspond to rotations of the intermediate roller 121 and the conveying roller 131 which are started at the point T3 of time in the time chart of FIG. 4.

After the above-described procedure have been started in step S270, the control flow goes back to step S190 in which the main controller 10 waits for the following sheet P to be positioned into the image formation position. Then, when the following sheet P becomes ready for image formation, step S130 is implemented whereby the main controller 10 starts procedure for the one-movement image formation. The ink ejection, performed onto the following sheet P in the one-movement image formation procedure started in step 130, corresponds to ink ejection that is started at a point T4 of time in the time chart of FIG. 4.

Figure 5:
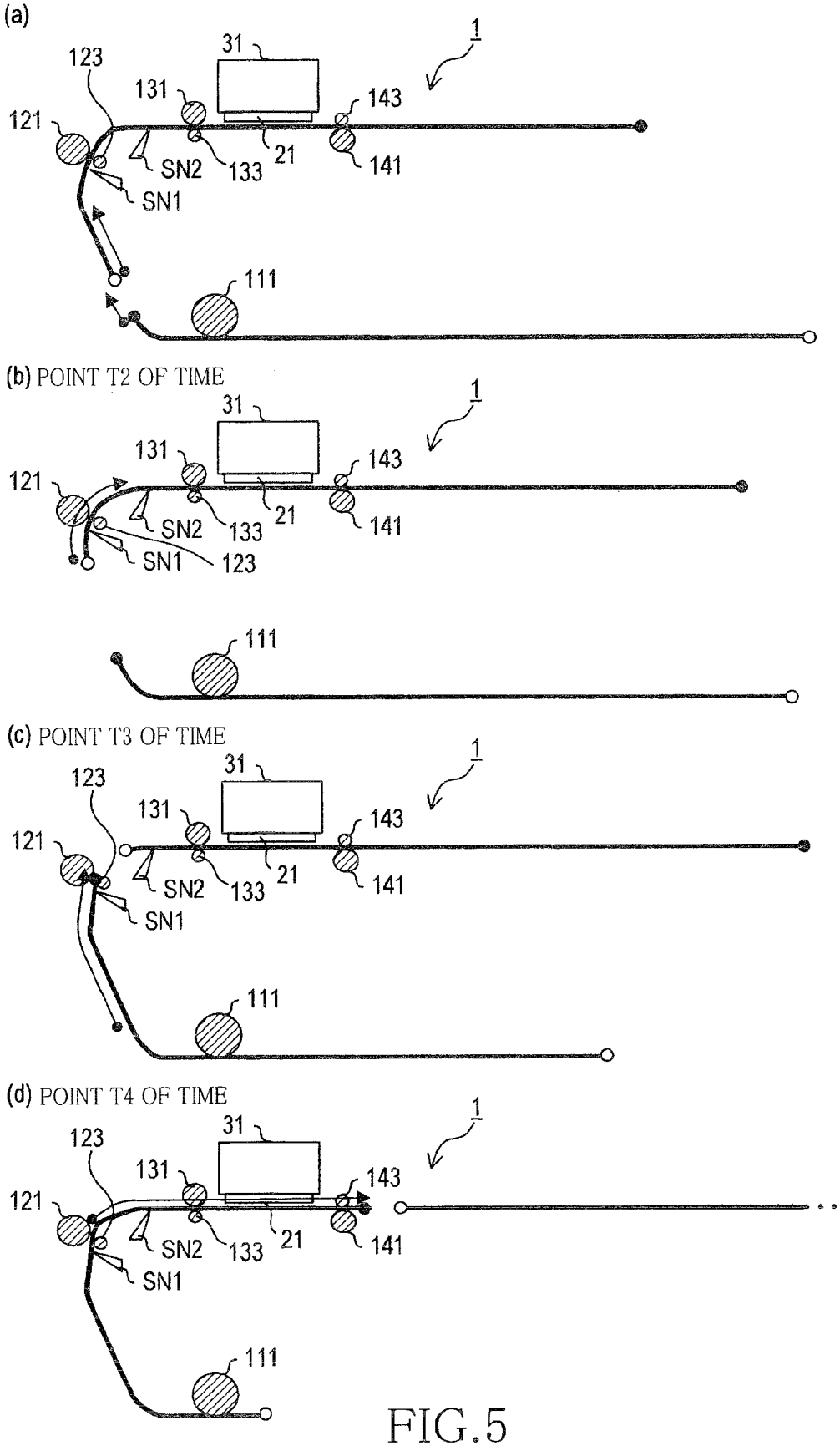
FIG. 5 is a set of views showing positions of conveyed preceding and following sheets in various stages in the first embodiment.

The print control routine of FIG. 3 is executed as described above. During execution of the print control routine of FIG. 3, the preceding and following sheets P are conveyed as shown in FIG. 5. View (a) of FIG. 5 shows positions of the preceding and following sheets P in an early stage of the accompanying conveyance of the following sheet P. View (b) of FIG. 5 shows positions of the preceding and following sheets P at the point T2 of time that is indicated in the time chart of FIG. 4. View (c) of FIG. 5 shows positions of the preceding and following sheets P at the point T3 of time that is indicated in the time chart of FIG. 4. View (d) of FIG. 5 shows positions of the preceding and following sheets P at the point T4 of time that is indicated in the time chart of FIG. 4.

In the image forming apparatus 1 of the present embodiment, step S200 is implemented to start performing the accompanying conveyance of the following sheet P concurrently with the conveyance of the preceding sheet P, and step S250 is implemented, upon the positive judgment in step S230 when the trailing end of the preceding sheet P has passed the position of detection made by the sheet sensor SN1, to start conveying the following sheet P at the high conveying velocity (that is higher than the velocity of the accompanying conveyance) to the position of disposition of the intermediate roller 121. Further, the accompanying conveyance of the following sheet P is not performed when it is predicted that the trailing end of the preceding sheet P will pass the position of detection made by the sheet sensor SN1 as a result of conveyance of the preceding sheet P. In other words, one of the successive intermittent accompanying conveyances of the following sheet P, which is to be performed together with one of the successive intermittent conveyances of the preceding sheet P which is to be performed to cause the trailing end of the preceding sheet P to pass the position of detection made by the sheet sensor SN1, is predicted, and the predicted one of the successive intermittent accompanying conveyances of the following sheet P is inhibited. This arrangement makes it possible to convey the following sheet P at the high conveying velocity upon detection of the trailing end of the preceding sheet P by the sheet sensor SN1, and accordingly to rapidly supply the following sheet P to the conveying roller 131. Therefore, consequently, the following sheet P can be rapidly positioned into the image formation position.

In FIG. 4, broken line shows activations of the rollers 111, 121, 131 in an arrangement in which the accompanying conveyance of the following sheet P is not inhibited but is performed even together with the above-described one of the successive intermittent conveyances of the preceding sheet P which causes the trailing end of the preceding sheet P to pass the position of detection made by the sheet sensor SN1. In this arrangement, the high-velocity conveyance of the following sheet P to the position of disposition of the intermediate roller 121 cannot be started upon detection of the trailing end of the preceding sheet P by the sheet sensor SN1, i.e., upon release of the preceding sheet P from the intermediate roller 121. In other words, in this arrangement, the high-velocity conveyance of the following sheet P cannot be started until the accompanying conveyance has been completed. Consequently, in this arrangement, the following sheet P cannot be rapidly supplied to the conveying roller 131 so as to be positioned into the image formation position.

On the other hand, in the image forming apparatus 1 according to the present embodiment, the accompanying conveyance of the following sheet P is inhibited from being performed together with the above-described one of the successive intermittent conveyances of the preceding sheet P which causes the trailing end of the preceding sheet P to pass the position of detection made by the sheet sensor SN1. Owing to this inhibition arrangement, the following sheet P can be rapidly supplied to the conveying roller 131 so as to be positioned into the image formation position. Therefore, where the image formation is to be performed onto a plurality of sheets, the image formation procedure performed onto a sheet can be rapidly followed by the image formation procedure that is performed onto the following sheet, thereby resulting in remarkable increase of throughput of the image forming apparatus 1, i.e., remarkable increase of capacity of the apparatus 1 for quickly handling a large number of sheets.

The image forming apparatus 1 according to the present embodiment is equipped with the intermediate roller 121. However, the present invention is applicable to an image forming apparatus 2, as shown in FIG. 8, which is not equipped with the intermediate roller 121 and the pinch roller 123.

Second Embodiment

Figure 8:
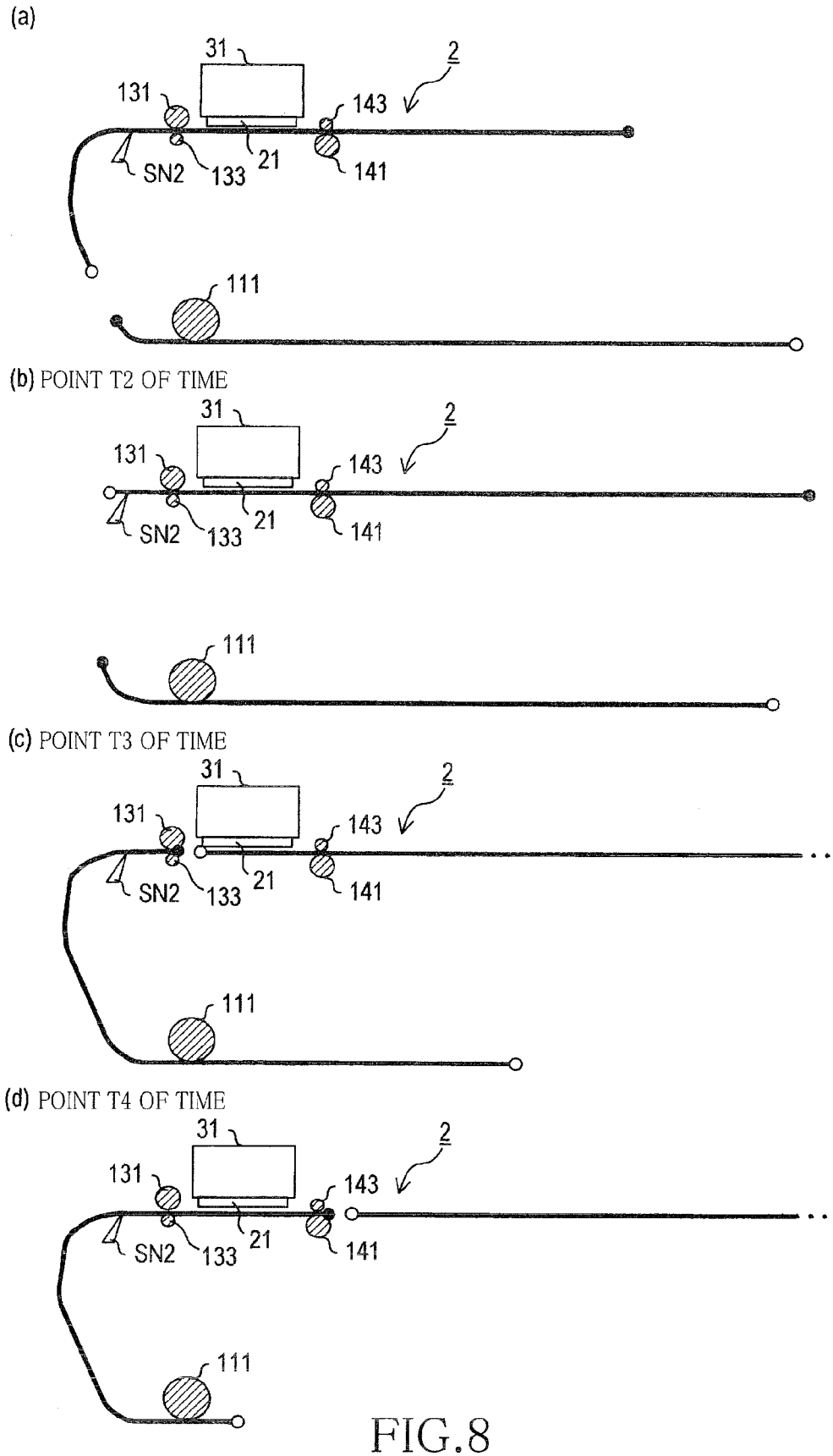
FIG. 8 is a set of views showing positions of conveyed preceding and following sheets in various stages in the second embodiment.

As shown in FIG. 8, the image forming apparatus 2 constructed according to a second embodiment of the invention is an image forming apparatus in which the above-described intermediate roller 121, pinch roller 123 and sheet sensor SN1 are not disposed in the sheet conveyance path between the supplying roller 111 and the conveying roller 131. That is, in the image forming apparatus 2, the supplying motor M1 is provided for rotating only the supplying roller 111, so that each of the sheets P stacked on the sheet supply tray 101 is to be conveyed to the position of disposition of the conveying roller 131 by rotation of the supplying roller 111 which is made by the supplying motor M1 under control by the sheet supply controller 80. The image forming apparatus 2 is identical with the image forming apparatus 1 according to the first embodiment, except for absence of the intermediate roller 121, pinch roller 123 and sheet sensor SN1. The same reference numerals as used in the first embodiment will be used to identify the same or similar elements, and redundant description of these elements will not be provided.

Figure 6:
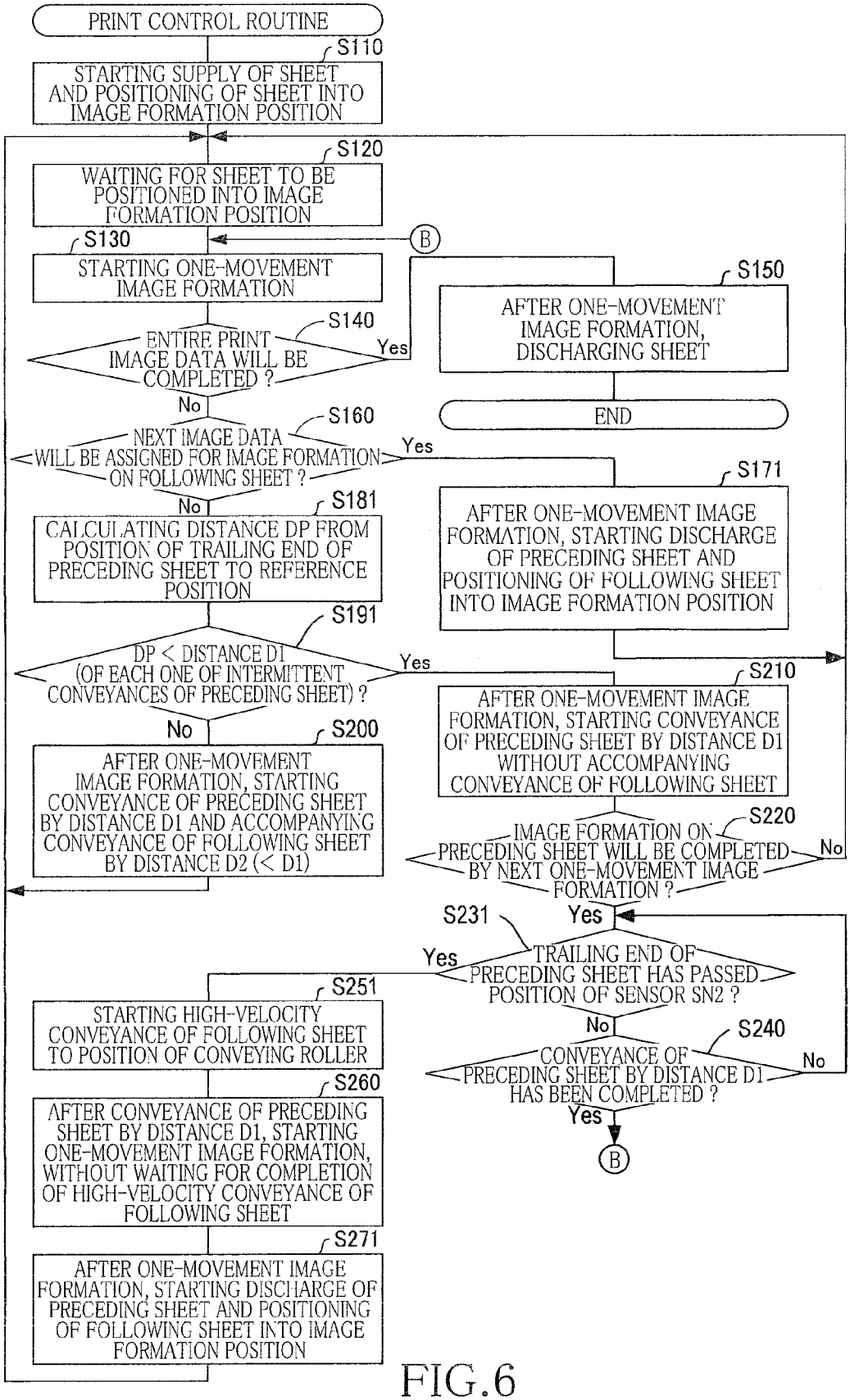
FIG. 6 is a flow chart showing a print control routine that is to be executed in a second embodiment of the invention.

In the image forming apparatus 2 according to the second embodiment, the main controller 10 is configured, upon reception of the print command supplied from the personal computer as the external device, to execute a print control routine shown in FIG. 6, so that a series of images based on the print image data supplied together with the print command can be formed on the sheet P. In FIG. 6, the same step numerals as used in print control routine of FIG. 4 will be used to identify steps that are to be implemented for performing the same procedure in the first embodiment, and these steps will not be described or described briefly.

The print control routine of FIG. 6 is initiated with step S110 in which the main controller 10 starts procedure for positioning the sheet P into the image formation position through the sheet supply controller 80 and the sheet conveyance controller 60. Then, in step S130, the main controller 10 starts the one-movement image formation procedure. In step S140, it is judged by the main controller 10 whether or not the image formation based on the entire print image data (including a final end portion of the entire print image data) will be completed by the one-movement image formation procedure that has been started in step S130. When a positive judgment (YES) is obtained in step S140, the control flow goes to step S150 in which, after the image formation on the sheet P has been completed, the sheet P having the image formed thereon is discharged through the sheet conveyance controller 60. The print control routine is ended by implementation of step S150.

On the other hand, when a negative judgment (NO) is obtained in step S140, the control flow goes to step S160 in which it is judged whether or not a next image data represents the image that is to be formed on a next page. When a positive judgment (YES) is obtained in step S160, the control flow goes to step S171 which is implemented, after completion of the one-movement image formation procedure having been started in step S130, to start procedure for discharging the preceding sheet P and positioning the following sheet P into the image formation position, by causing the sheet conveyance controller 60 and the sheet supply controller 80 to control the conveying roller 131, discharging roller 141 and supplying roller 111, such that the preceding sheet P (on which the image has been formed) is discharged toward the sheet exit tray (not shown) by rotating the conveying roller 131 and the discharging roller 141 under control by the sheet conveyance controller 60 while the following sheet P is started to be supplied toward the conveying roller 131 by rotating the supplying roller 111 under control by the sheet supply controller 80 upon detection of the trailing end of the preceding sheet P by the register sensor SN2, and then the following sheet P is positioned into the image formation position by rotating the conveying roller 131 under control by the sheet conveyance controller 60 after the following sheet has been supplied to conveying roller 131. Thereafter, in step S130, the procedure for forming the image on the following sheet P is started at a point of time at which the positioning of the following sheet P into the image formation position is completed.

On the other hand, when a negative judgment (NO) is obtained in step S160, the control flow goes to step S181 in which the main controller 10 calculates a distance Dp as measured along the sheet conveyance path between the position X1 of the trailing end of the preceding sheet P (that is subjected to the one-movement image formation procedure that has been started in step S130) and the reference position, i.e., a position of detection made by the register sensor SN2. It is noted that the calculation of the distance Dp can be made by the same concept by which the calculation of the distance Ds is made in the first embodiment.

Step S181 is followed by step S191 that is implemented to judge whether or not the trailing end of the preceding sheet P will be caused to pass the reference position as a result of a next one of the successive intermittent conveyances of the preceding sheet P, by judging whether or not the distance Dp is shorter than the first distance D1 (by which the sheet P is conveyed by each one of the successive intermittent conveyances). When a negative judgment (NO) is obtained in step S191, the control flow goes to step S200 in which, upon completion of the one-movement image formation procedure that has been started in step S130, the accompanying conveyance of the following sheet P is performed by rotation of the supplying roller 111 together with each one of the successive intermittent conveyances of the preceding sheet P that is performed by rotation of the conveying roller 131. In this instance, when the trailing end of the preceding sheet P has not yet passed the supplying roller 111, namely, when the preceding sheet P is being conveyed by the supplying roller 111 as well as the conveying roller 131, the preceding sheet P is conveyed by the first distance D1 rather than by the second distance D2, since a conveying force applied to the sheet P by the conveying roller 131 (which can be considered to correspond to a nipping force applied to the sheet P by cooperation of the conveying roller 131 and the pinch roller 133, or a friction force generated between the sheet P and the rollers 131, 133) overcomes a conveying force applied to the sheet P by the supplying roller 111. After the trailing end of the preceding sheet P has passed the supplying roller 111, the following sheet P is started to be conveyed by rotation of the supplying roller 111 in this step S200.

Thus, in step S200, the main controller 10 starts procedure for conveying the preceding sheet P by the first distance D1 and at the same time conveying the following sheet P by the second distance D2. Step S200 is followed by step S120 in which the main controller 10 waits for completion of conveyance of the preceding sheet P by the first distance D1 and also completion of conveyance of the following sheet by the second distance D2. Then, the main controller 20 starts another one-movement image formation procedure.

While the one-movement image formation and the conveyance of the preceding and following sheets P are repeatedly performed, a point of time comes when the distance Dp becomes shorter than the first distance D1, and then a point of time comes when the trailing end of the preceding sheet P passes the position of detection of the trailing end of the preceding sheet P by the register sensor SN2. When the distance Dp becomes shorter than the first distance D1, namely, when a positive judgment (YES) is obtained in step S191, the main controller 10 predicts that the trailing end of the preceding sheet P will pass the position of detection of an end of the sheet P by the register sensor SN2 as a result of a next one of the successive intermittent conveyances of the preceding sheet P. The positive judgment (YES) in step S191 is followed by step S210 in which, after completion of the one-movement image formation procedure having been started in step S130, the main controller 10 starts procedure for conveying the preceding sheet P by the first distance D1 without the accompanying conveyance of the following sheet P, by rotating only the conveying roller 131 and the discharging roller 141.

After the main controller 10 has started the procedure for conveying the preceding sheet P without the accompanying conveyance of the following sheet P, step S220 is implemented to judge whether or not the image formation on the preceding sheet P will be completed by another one-movement image formation procedure, and to judge whether or not the entire print image data contains data that requires image formation on the next page. In step S220, a negative judgment (NO) is obtained, when it is judged that the image formation on the preceding sheet P will not be completed by the next one-movement image formation procedure and/or that the entire print image data does not contain data that requires image formation on the next page. When the negative judgment (NO) is obtained in step S220, the control flow goes back to step S120 in which the main controller 10 waits for completion of the conveyance of the preceding sheet P that has been started in step S210. Upon completion of the conveyance of the preceding sheet P by the first distance D1, step S130 is implemented to start the one-movement image formation procedure.

On the other hand, in step S220, a positive judgment (YES) is obtained, when it is judged that the image formation on the preceding sheet P will be completed by the next one-movement image formation procedure and that the entire print image data contains data that requires image formation on the next page. When the positive judgment (YES) is obtained in step S220, the control flow goes to step S231 in which it is judged whether or not the trailing end preceding sheet P has passed the position of detection of an end of the sheet P by the register sensor SN2, namely, whether or not the trailing end of the preceding sheet P has been detected by the register sensor SN2. When a negative judgment (NO) is obtained in step S231, the control flow goes to step S240 in which it is judged whether or not the conveyance of the preceding sheet P (that has been started in step S210) has been completed. As long as a negative judgment (NO) is obtained in step S240, the control flow goes back to step S231. When the conveyance of the preceding sheet P has been completed without the trailing end of the preceding sheet P being detected by the register sensor SN2, namely, when a positive judgment (YES) is obtained in step S240, the control flow goes back to step S130.

Figure 7:
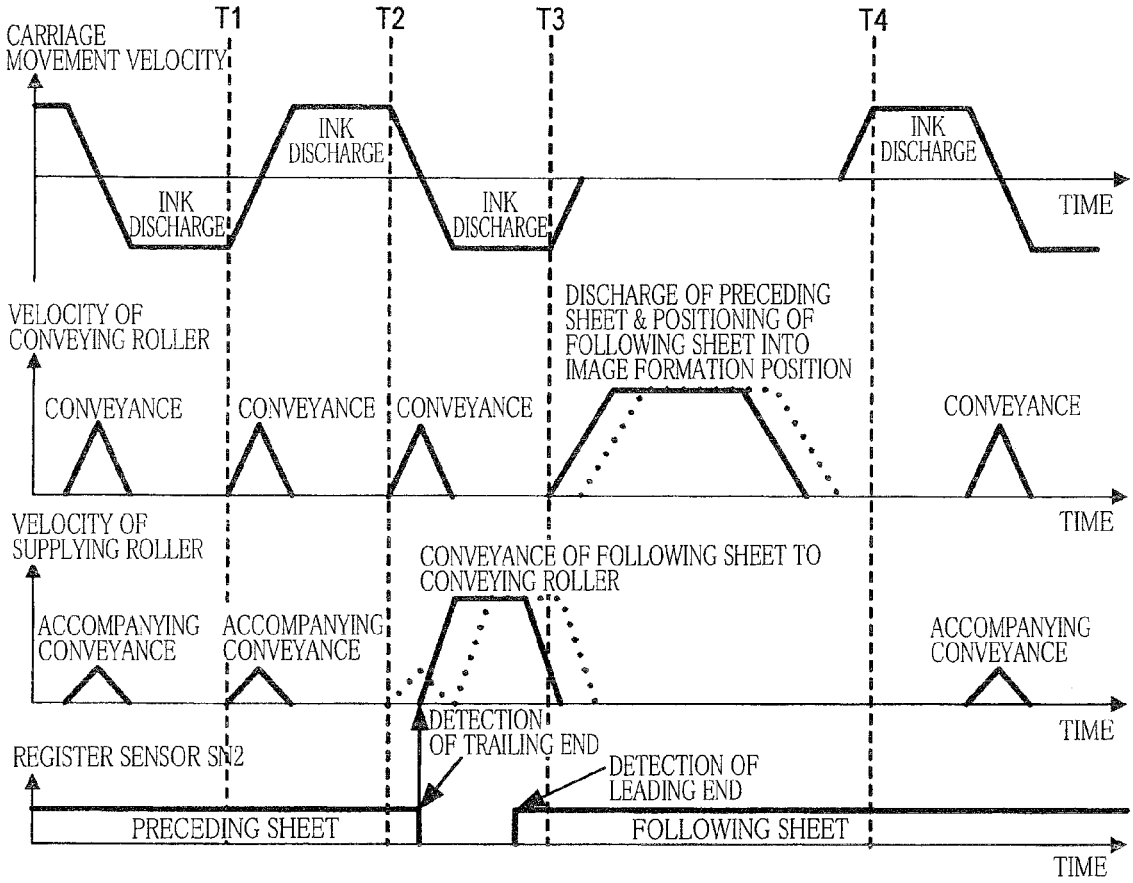
FIG. 7 is a view showing activations of the carriage 31 and the rollers in the second embodiment.

When the trailing end of the preceding sheet P is detected by the register sensor SN2, namely, when a positive judgment (YES) is obtained in step S231, the control flow goes to step S251 in which, as shown in a portion of the time chart of FIG. 7 that represents a stage between points T2 and T3 of time, the main controller 10 starts procedure for causing the sheet supply controller 80 to convey the following sheet P to the position of disposition of the conveying roller 131 at a high conveying velocity (third conveying velocity) that is higher than the velocity of the accompanying conveyance of the following sheet P, by rotating the supplying roller 111 under control by the sheet supply controller 80. Step S251 is followed by step S260 in which, immediately after completion of the conveyance of the preceding sheet P (that has been started in step S210) without waiting for completion of the high-velocity conveyance of the following sheet P (that has been started in step S251), the main controller 10 starts procedure for the one-movement image formation. In step S271 following step S260, after completion of the image formation on the preceding sheet P, the main controller 10 starts procedure for causing the sheet conveyance controller 60, to convey the following sheet P (that has waited in the position of disposition of the conveying roller 131) so as to be positioned into the image formation position, and to discharge the preceding sheet P toward the sheet exit tray (not shown), by rotating the conveying roller 131 and the discharging roller 141 under control by the sheet conveyance controller 60. The rotation of the conveying roller 131, which is started by implementation of step S271, corresponds to rotation of the conveying roller 131 which is started at the point T3 of time in the time chart or FIG. 7.

After the above-described procedure have been started in step S271, the control flow goes back to step S120 in which the main controller 10 waits for the following sheet P to be positioned into the image formation position. Then, when the following sheet P becomes ready for image formation, step S130 is implemented whereby the main controller 10 starts procedure for the one-movement image formation. The ink ejection, performed onto the following sheet P in the one-movement image formation procedure started in step 130, corresponds to ink ejection that is started at a point T4 of time in the time chart of FIG. 7.

The print control routine of FIG. 6 is executed as described above. During execution of the print control routine of FIG. 6, the preceding and following sheets P are conveyed as shown in FIG. 8. View (a) of FIG. 8 shows positions of the preceding and following sheets P in an early stage of the accompanying conveyance of the following sheet P. View (b) of FIG. 8 shows positions of the preceding and following sheets P at the point T2 of time that is indicated in the time chart of FIG. 7. View (c) of FIG. 8 shows positions of the preceding and following sheets P at the point T3 of time that is indicated in the time chart of FIG. 7. View (d) of FIG. 8 shows positions of the preceding and following sheets P at the point T4 of time that is indicated in the time chart of FIG. 7.

In the image forming apparatus 2 of the present second embodiment, step S200 is implemented to start performing the accompanying conveyance of the following sheet P concurrently with the conveyance of the preceding sheet P, and step S251 is implemented, upon the positive judgment in step S231 when the trailing end of the preceding sheet P has passed the position of detection made by the register sensor SN2, to start conveying the following sheet P at the high conveying velocity (that is higher than the velocity of the accompanying conveyance) to the position of disposition of the conveying roller 131. Further, the accompanying conveyance of the following sheet P is not performed when it is predicted that the trailing end of the preceding sheet P will pass the position of detection made by the register sensor SN2 as a result of conveyance of the preceding sheet P. This arrangement makes it possible to convey the following sheet P at the high conveying velocity upon detection of the trailing end of the preceding sheet P by the register sensor SN2, and accordingly to rapidly supply the following sheet P to the conveying roller 131. It is noted that, in FIG. 7, broken line shows activations of the rollers 111, 131 in an arrangement in which the accompanying conveyance of the following sheet P is not inhibited but is performed even together with the above-described one of the successive intermittent conveyances of the preceding sheet P which causes the trailing end of the preceding sheet P to pass the position of detection made by the register sensor SN2.

In the above-described embodiments, an image forming device is at least partially constituted by the image forming unit 21, image formation controller 20 and carriage controller 40. A sheet conveying mechanism is constituted by a roller mechanism including the conveying roller 131 and pinch roller 133. A sheet supplying mechanism is constituted by a roller mechanism (first conveying-force transmitting portion) including the supplying roller 111 and optionally a roller mechanism (second conveying-force transmitting portion) including the intermediate roller 121 and pinch roller 123.

Further, in the above-described embodiments, a conveyance controlling device is constituted by portions of the sheet conveyance controller 60 and main controller 10 which are assigned to implement steps S200 and S210 (procedure for conveying the preceding sheet P by the first distance D1) and step S270 or S271 (procedure for positioning the following sheet P into the image formation position). A judging device is constituted by a portion of the main controller 10 which is assigned to implement step S230 or S231.

Further, in the above-described embodiments, a first controlling portion of the supply controlling device is constituted by portions of the sheet supply controller 80 and main controller 10 which are assigned to implement step S200 (procedure for conveying the following sheet P by the second distance D2 together with conveyance of the preceding sheet P). A predicting device of the supply controlling device is constituted by portions of the sheet supply controller 80 and main controller 10 which are assigned to implement steps S180, S190 or steps S181, S191. A second controlling portion of the supply controlling device is constituted by portions of the sheet supply controller 80 and main controller 10 which are assigned to implement step S210 for inhibiting the accompanying conveyance of the following sheet P according to result of the judgment made in step S190 or S191, and also step S250 or S251 for conveying the following sheet P at the high conveying velocity to the reference position from a point of time at which the positive judgment (YES) is obtained in step S230 or S231. A third controlling portion of the supply controlling device is constituted by portions of the sheet supply controller 80 and main controller 10 which are assigned to implement step S270 for supplying the following sheet P to the position of disposition of the conveying roller 131 by rotating the intermediate roller 121.

In the image forming apparatus 2 according to the second embodiment, a predetermined position is disposed at the sheet conveying mechanism, and the second controlling portion is configured to convey the following sheet P at the high conveying velocity, by activating the sheet supplying mechanism in the form of the sheet supply roller 111, from the point of time at which it is judged that the trailing end of the preceding sheet P has passed the reference position (i.e., position in which an end of the sheet P is to be detected by the register sensor SN2), to the point of time at which the leading end of the following sheet P reaches the predetermined position corresponding to a downstream-side position that is located on a downstream side of the reference position in the sheet conveyance path. In the image forming apparatus 1 according to the first embodiment, the predetermined position is disposed on an upstream side of the sheet conveying mechanism in the sheet conveyance path, and the second controlling portion is configured to convey the following sheet P at the high conveying velocity, by activating the sheet supplying mechanism in the form of the rollers 111, 121, 123, from the point of time at which it is judged that the trailing end of the preceding sheet P has passed the reference position (i.e., position of disposition of the intermediate roller 121, which corresponds to position Xm in which an end of the sheet P is to be detected by the sheet sensor SN1), to the point of time at which the leading end of the following sheet P reaches the predetermined position corresponding to the reference position.

Figure 9:
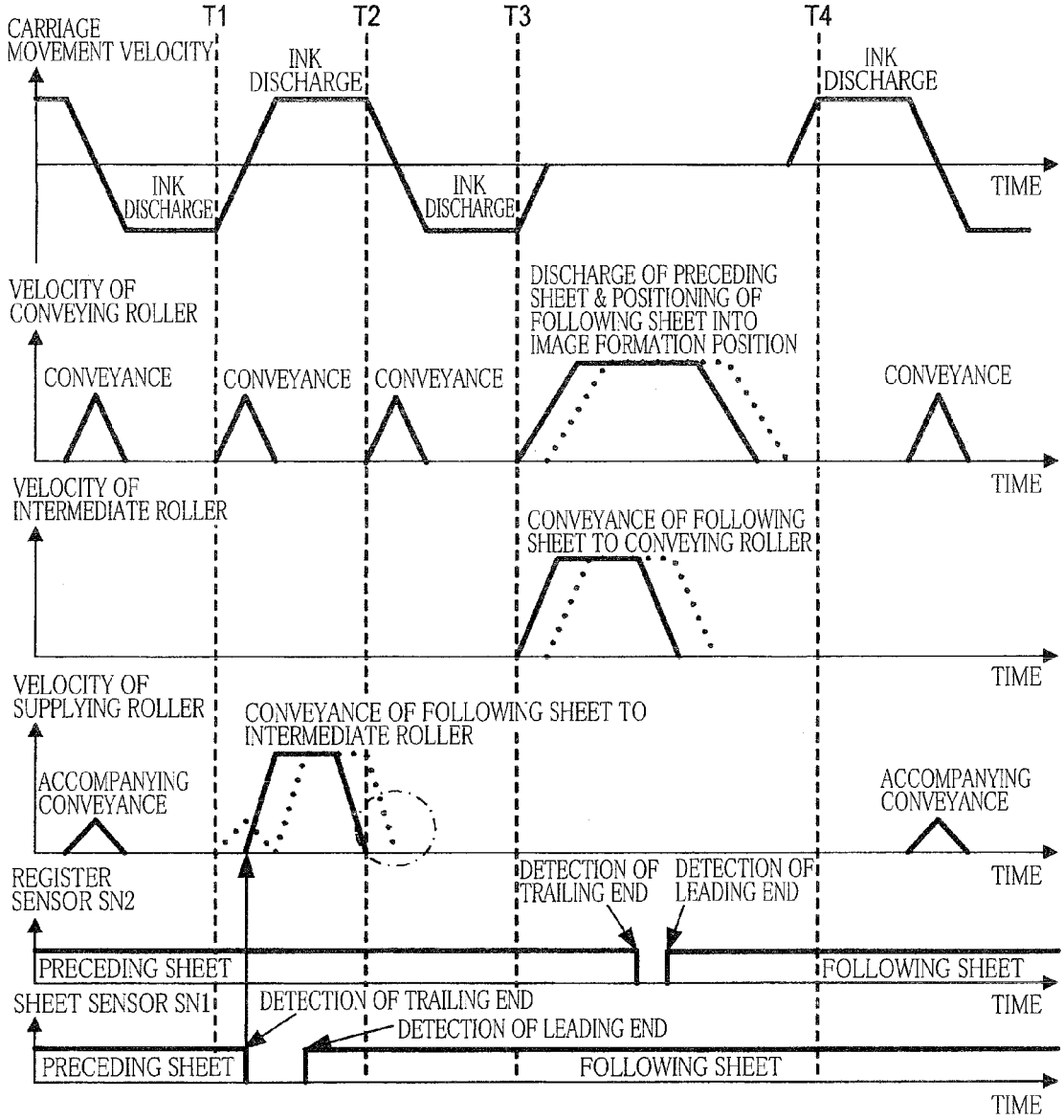
FIG. 9 is a view showing activations of the carriage 31 and the rollers in a modification of the first embodiment.

The present invention is not limited to the details of the above-described embodiments, but may be otherwise embodied. For example, in the image forming apparatus 1 according to the first embodiment, the image formation on the preceding sheet P is completed by the one-movement image formation procedure that is performed after the above-described one of the successive intermittent conveyances which causes the trailing end of the preceding sheet P to pass the position of detection made by the sheet sensor SN1, and then the image formation on the following sheet P is started. However, the invention is applicable to a modification of the first embodiment in which the image formation on the preceding sheet P is continued by continuing the intermittent conveyance of the preceding sheet P even after the one of the successive intermittent conveyances which causes the trailing end of the preceding sheet P to pass the position of detection made by the sheet sensor SN1. FIG. 9 shows activations of the carriage 31 and the rollers 111, 121, 131 in this modification of the first embodiment. In the modification, as shown in FIG. 9, after the following sheet P has been conveyed to the position of disposition of the intermediate roller 121, the following sheet P is caused to wait for a while without the accompanying conveyance thereof, while the preceding sheet P is conveyed by the first distance D1. Then, the following sheet P is supplied to the conveying roller 131, together with discharge of the preceding sheet P. In this instance, in a stage indicated by one-dot chain line circle, the following sheet P (which has been just conveyed to the intermediate roller 112) may be conveyed together with the conveyance of the preceding sheet P. Thus, where the preceding sheet P is further conveyed by the first distance D1 even after the following sheet P has been conveyed at the high conveying velocity to the intermediate roller 121, the accompanying conveyance of the following sheet P may be continued together with the conveyance of the preceding sheet P, for thereby enabling the following sheet P to be further rapidly positioned into the image formation position.

In the above-described embodiments, the above-described predicted one of the successive intermittent accompanying conveyances of the following sheet P is inhibited, and the high-velocity conveyance of the following sheet P toward the conveying mechanism at the third conveying velocity is started after a given length of time has passed from a point of time at which the predicted one of the successive intermittent conveyances of the following sheet should have been started if the predicted one had not been inhibited, wherein the given length of time is dependent on the first conveying velocity (i.e., velocity of conveyance of the preceding sheet P by the conveying roller 131) and the distance between the trailing end of the preceding sheet P and the reference position (i.e., position of detection by the sheet sensor SN1 or position of detection by the register sensor SN2) upon start of the above-described one of the successive intermittent conveyances of the preceding sheet P (which causes the trailing end of the preceding sheet P to pass the reference position). However, particularly, in a case where the distance between the trailing end of the preceding sheet P and the reference position is large, the above-described given length of time is large so that the supplying roller 111 is caused to wait for such a large length of time without the roller 111 being rotated. That is, depending upon a relationship among the first conveying velocity, the second conveying velocity (i.e., velocity of accompanying conveyance of the following sheet P by the supplying roller 111), the third conveying velocity (i.e., velocity of the high-velocity conveyance of the following sheet P by the supplying roller 111) and the distance between the trailing end of the preceding sheet P and the reference position (upon start of the above-described one of the successive intermittent conveyances of the preceding sheet P), there is a case where the following sheet P can be more rapidly positioned into the image formation position, by refraining from inhibiting the predicted one of the successive intermittent accompanying conveyances of the following sheet P, and then starting conveying the following sheet P toward the sheet conveying mechanism at the third conveying velocity, at a point of time at which the predicted one of the successive intermittent accompanying conveyances of the following sheet P is completed. In view of such a case, it is possible to determine a threshold value, based on the first conveyance velocity, second conveyance velocity and third conveyance velocity, such that the following sheet P can reach the intermediate roller 121 or conveying roller 131 earlier by allowing the predicted one of the successive intermittent accompanying conveyances of the following sheet P where the distance between the trailing end of the preceding sheet P and the reference position is larger than the determined threshold value. Specifically, in the above-described print control routine of FIG. 3 or FIG. 6, after a positive judgment (YES) has be obtained in step S190 or S191, it is possible to judge whether the predicted one of the successive intermittent accompanying conveyances of the following sheet P should be inhibited or not, by comparing the distance and the threshold value.

Further, in the above-described embodiments, steps S230 and S231 are implemented to judge whether or not the trailing end of the preceding sheet P has passed the reference position, based on a signal representing detection made by the sensor SN1 or SN2. However, this judgment does not necessarily have to be made based on the detection by the sensor, but may be made without relying on the detection by the sensor, for example, by estimating a position of the trailing end of the preceding sheet P based on a known size of the sheet P and a rotational amount of the conveying roller 131 which is detectable by the encoder 65.

Further, in the above-described embodiments, steps S190 and S191 are implemented to judge whether or not the trailing end of the preceding sheet P will pass the reference position as a result of a next one of the successive intermittent conveyances of the preceding sheet P, by seeing whether or not the calculated distance (between the trailing end of the preceding sheet P and the reference position) is shorter than the first distance D1 (by which the preceding sheet P is conveyed as a result of each one of successive intermittent conveyances of the preceding sheet P by the conveying roller 131). However, this judgment does not necessarily have to be made by seeing whether or not the calculated distance is shorter than the first distance D1, but may be made by comparing a length of time required for the trailing end of the preceding sheet P to reach the reference position, with a length of time required for each one of the successive intermittent conveyances of the preceding sheet P. Further, this judgment does not necessarily have to be made every time each one of the successive intermittent conveyances of the preceding sheet P is to be performed, but may be made once upon start of the successive intermittent conveyances of the preceding sheet P, based on a known size of the preceding sheet P and a distance (i.e., distance D1) by which the preceding sheet P is conveyed as a result of each one of successive intermittent conveyances of the preceding sheet P.

What is claimed is:

1. An image forming apparatus comprising:

an image forming device configured to form an image on a sheet in an image formation position;

a conveyance controlling device configured to intermittently convey the sheet toward the image formation position at a first conveying velocity along a sheet conveyance path, by activating a sheet conveying mechanism that is disposed on an upstream side of the image formation position in the sheet conveyance path, such that the sheet is conveyed toward the image formation position by a first distance, as a result of each one of successive intermittent conveyances of the sheet which is performed by said conveyance controlling device;

a supply controlling device configured to supply the sheet to said sheet conveying mechanism, by activating a sheet supplying mechanism that is disposed on an upstream side of said sheet conveying mechanism in the sheet conveyance path; and a judging device configured to judge whether or not a trailing end of the sheet conveyed by said conveyance controlling device has passed a reference position that is located between said sheet conveying mechanism and said sheet supplying mechanism in the sheet conveyance path, wherein said supply controlling device includes:

(i) a first controlling portion configured to intermittently convey another sheet as a following sheet following the sheet as a preceding sheet, toward said sheet conveying mechanism at a second conveying velocity lower than the first conveying velocity along the sheet conveyance path, by activating said sheet supplying mechanism when the preceding sheet is being intermittently conveyed by said conveyance controlling device, such that the following sheet is conveyed toward said sheet conveying mechanism by a second distance shorter than the first distance, as a result of each one of successive intermittent conveyances of the following sheet which is performed by said first controlling portion together with a corresponding one of the successive intermittent conveyances of the preceding sheet which is performed by said conveyance controlling device;

(ii) a predicting portion configured to predict one of the successive intermittent conveyances of the following sheet which is to be performed together with one of the successive intermittent conveyances of the preceding sheet which is to be performed to cause the trailing end of the preceding sheet to pass the reference position; and (iii) a second controlling portion configured to inhibit the predicted one of the successive intermittent conveyances of the following sheet, and configured to convey the following sheet toward said sheet conveying mechanism at a third conveying velocity higher than the second conveying velocity along the sheet conveyance path, by activating said sheet supplying mechanism from a point of time at which said judging device judges that the trailing end of the preceding sheet has passed the reference position, such that conveyance of the following sheet at the third conveying velocity is stopped without a leading end of the following sheet being brought into contact with the trailing end of the preceding sheet.

2. The image forming apparatus according to claim 1, wherein said second controlling portion is configured to convey the following sheet toward said sheet conveying mechanism at the third conveying velocity, by activating said sheet supplying mechanism from the point of time at which said judging device judges that the trailing end of the preceding sheet has passed the reference position, to a point of time at which a leading end of the following sheet reaches a predetermined position corresponding to one of the reference position and a downstream-side position that is located on a downstream side of the reference position in the sheet conveyance path.

3. The image forming apparatus according to claim 2, wherein the predetermined position is disposed at said sheet conveying mechanism, and wherein said second controlling portion of said supply controlling device is configured to supply the following sheet to said sheet conveying mechanism, by conveying the following sheet, such that the following sheet is conveyed by activating said sheet supplying mechanism, from the point of time at which said judging device judges that the trailing end of the preceding sheet has passed the reference position, to the point of time at which the leading end of the following sheet reaches the predetermined position.

4. The image forming apparatus according to claim 2, wherein the predetermined position is disposed on an upstream side of said sheet conveying mechanism in the sheet conveyance path, and wherein said second controlling portion of said supply controlling device is configured to supply the following sheet to the predetermined position that is located on an upstream side of said sheet conveying mechanism in the sheet conveyance path, by conveying the following sheet, such that the following sheet is conveyed by activating said sheet supplying mechanism, from the point of time at which said judging device judges that the trailing end of the preceding sheet has passed the reference position, to the point of time at which the leading end of the following sheet reaches the predetermined position.

5. The image forming apparatus according to claim 4, wherein said conveyance controlling device is configured, after said one of the successive intermittent conveyances of the preceding sheet has been performed to cause the trailing end of the preceding sheet to pass the reference position, to activate said sheet conveying mechanism, for thereby positioning the following sheet into the image formation position while is charging the preceding sheet, and then starting to perform the successive intermittent conveyances of the following sheet at the first conveying velocity and wherein said supply controlling device includes a third controlling portion which is configured, when the following sheet is to be positioned into the image formation position by said conveyance controlling device after the following sheet has been conveyed at the third velocity to the predetermined position by said second controlling portion, to activate said sheet supplying mechanism for thereby supplying the following sheet to said sheet conveying mechanism.

6. The image forming apparatus according to claim 4, wherein said sheet supplying mechanism includes a plurality of conveying-force transmitting portions which are disposed in respective different positions along the sheet conveyance path and which are configured to transmit conveying force to the sheet, so that the sheet is conveyed to said sheet conveying mechanism by cooperation of said plurality of conveying-force transmitting portions, and wherein the predetermined position is disposed at one of said conveying-force transmitting portions which is closer to said sheet conveying mechanism than the other of said conveying-force transmitting portions.

7. The image forming apparatus according to claim 1, further comprising a sensor configured to detect an end of the sheet when the sheet is passing the reference position, wherein said judging device is configured to judge, based on a signal representing detection made by said sensor, whether or not the trailing end of the sheet has passed the reference position.

8. The image forming apparatus according to claim 1, wherein said predicting portion is configured to determine a position of the preceding sheet conveyed by said conveyance controlling device along the sheet conveyance path, and is configured to predict, as the predicted one of the successive intermittent conveyances, one of the successive intermittent conveyances of the following sheet which is to be performed together with one of the successive intermittent conveyances of the preceding sheet which is to be performed after a distance between the trailing end of the preceding sheet and the reference position has become shorter than the first distance.

9. The image forming apparatus according to claim 1, wherein said second controlling portion is configured, in case of inhibition of the predicted one of the successive intermittent conveyances of the following sheet, to start conveying the following sheet toward said sheet conveying mechanism at the third conveying velocity, after a given length of time has passed from a point of time at which the predicted one of the successive intermittent conveyances of the following sheet should have been started if the predicted one had not been inhibited, the given length of time being dependent on the first conveying velocity and a distance between the trailing end of the preceding sheet and the reference position upon start of the one of the successive intermittent conveyances of the preceding sheet, wherein said second controlling portion is configured to inhibit the predicted one of the successive intermittent conveyances of the following sheet, provided that the distance between the trailing end of the preceding sheet and the reference position is not larger than a threshold value that is determined based on the first conveyance velocity, the second conveyance velocity and the third conveyance velocity, wherein said second controlling portion is configured, provided that the distance between the trailing end of the preceding sheet and the reference position is larger than the threshold value, to refrain from inhibiting the predicted one of the successive intermittent conveyances of the following sheet, and to start conveying the following sheet toward said sheet conveying mechanism at the third conveying velocity, at a point of time at which the predicted one of the successive intermittent conveyances of the following sheet is completed.

* * * * *